US005364055A

United States Patent [19]

Abinanti

[11] Patent Number: 5,364,055

[45] Date of Patent: Nov. 15, 1994

[54] REPLACEABLE CUSHIONS FOR FIXTURES/HARDWARE SUPPORTING GLASS PANELS

[75] Inventor: T. Michael Abinanti, Palatine, Ill.

[73] Assignee: Met Displays, Inc., Chicago, Ill.

[21] Appl. No.: 859,895

[22] Filed: Mar. 30, 1992

[51] Int. Cl.[5] ..... A47G 1/10

[52] U.S. Cl. ..... 248/316.1; 248/225.31; 248/227; 248/235; 211/87; 211/90

[58] Field of Search ..... 248/316.1, 225.31, 316.6, 248/231.3, 235, 239, 220.2, 220.3, 227, 245, 250, 221.2, 221.3, 221.4, 687, 689; 211/90, 86, 87, 41; 312/127, 129, 130, 140; 108/106, 107, 108, 114, 152

[56] References Cited

U.S. PATENT DOCUMENTS

| | | | |
|---|---|---|---|
| 427,935 | 10/1890 | O'Brien | 248/235 |
| 1,259,011 | 3/1918 | Gerer | 211/86 |
| 1,835,294 | 12/1931 | Gilham | 248/205.5 X |
| 2,144,602 | 1/1939 | Balmer | 248/250 |
| 2,803,420 | 8/1957 | Hyde | 248/205.5 |
| 2,968,460 | 1/1961 | Van Dusen | 248/205.8 X |
| 3,101,566 | 8/1963 | Stiller | 248/205.5 X |
| 3,111,297 | 11/1963 | Conner | 248/231.3 X |
| 3,286,976 | 11/1966 | Lynch | 211/90 X |
| 3,331,514 | 7/1967 | Bruynzeel | 248/250 |
| 3,335,992 | 8/1967 | Frazier | 248/245 |
| 3,912,212 | 10/1975 | Betts, Sr. | 248/220.3 |
| 4,086,857 | 5/1978 | Igarashi . | |
| 4,347,795 | 9/1982 | Mäkinen . | |
| 4,376,521 | 3/1983 | Walters . | |
| 4,557,456 | 12/1985 | Mueller | 248/220.3 X |
| 4,691,887 | 9/1987 | Bessinger . | |
| 4,738,426 | 4/1988 | Bessinger . | |
| 4,863,545 | 9/1989 | Perfect | 248/205.5 X |
| 4,871,136 | 10/1989 | Bessinger et al. | 248/250 |
| 5,064,158 | 11/1991 | Brazier . | |
| 5,121,896 | 6/1992 | Frye | 248/205.5 |

*Primary Examiner*—Ramon O. Ramirez
*Assistant Examiner*—Korie H. Chan
*Attorney, Agent, or Firm*—Keck, Mahin & Cate

[57] ABSTRACT

A replaceable elastomeric cushion for use in an assembly with a glass panel and support fixture is disclosed. The replaceable elastomeric cushions are made of a soft compliant material and have one substantially planar surface for contacting the glass panel. A second surface has a number of projecting members which fit into corresponding orifices in the support fixture. The replaceable cushion thus rests between the glass panel and the support fixture to prevent marring or scratching of the glass. Since the replaceable cushions are not permanently attached to the support fixture, they may be easily replaced without having to replace the support fixture.

20 Claims, 4 Drawing Sheets

REPLACEABLE CUSHIONS FOR FIXTURES/HARDWARE SUPPORTING GLASS PANELS

BACKGROUND OF THE INVENTION

1. Field of the Invention

This invention relates to a replaceable cushion for a display assembly. More particularly, this invention relates to a replaceable elastomeric cushion for use with a glass panel and support fixture hardware interface, useful for display structures.

2. Background of the Invention

The use of glass panels in conjunction with metal and woodframes has long been utilized in modern furniture design. For example, glass panels have been used in conjunction with tables, shelving, display cases and other fixtures. Such glass panels may be used as a shelf or table surface in a horizontal orientation or as a structural member supporting fixtures in a vertical orientation to create an aesthetically pleasing effect as well as maximum structural stability. A problem with using such metal components in conjunction with glass panels is the potential for marring or scratching the glass panel, thus diminishing the aesthetic beauty of the particular piece of furniture.

Prior devices attempted to rectify this problem by attaching a piece of soft cushion material, such as some form of plastic or rubber, to the surfaces of the metal support structure by glue, epoxy or other adhesive before the assembly of the particular fixture to fix the cushion in place during assembly. The glass panel was then attached to the metal frame through contact with the soft cushion material in the conventional manner. Thus, the metal support structure did not directly contact the glass panel and did not mar or scratch the glass panel's surface.

However, these devices suffered from a lack of durability. Since the glass panel was pressed against the soft cushion material to insure that the glass panel stayed in place, a certain amount of wear and tear is inflicted on the soft material, especially if the glass panel is often removed and replaced. When the wear and tear damaged the soft cushion material, the soft cushion material had to be replaced. However, since the soft cushion material was permanently attached to the metal structure, both it and the support structure had to be replaced, although the support structure itself was otherwise usable. If the adhesive was omitted, difficulties were found in the assembling of the support structure as the cushion tended to move away from its proper position on the abutting surface during assembly.

In the context of the present invention, the use of an easily replaceable elastomeric cushion for secure placement between a support structure and a glass panel is contemplated as the beneficial advance. The use of such cushions will eliminate the wasteful replacement of metal support frames.

OBJECTS OF THE INVENTION

In view of the foregoing, it is an object of the invention to provide a replaceable elastomeric cushion for a metal structure supporting a glass panel.

Another object is to provide a replaceable elastomeric cushion device which may be easily removed from the support structure.

SUMMARY OF THE INVENTION

The foregoing objects are met by a replaceable elastomeric cushion for use with a support structure and glass panel assembly. The replaceable elastomeric cushion is made of a soft compliant material, having one substantially planar surface for contacting the glass panel. A second surface has a number of projecting members which fit into corresponding orifices in the support fixture.

The mounting structure comprises a frame structure with an abutting surface having an orifice provided therein, against which a replaceable elastomeric cushion having two opposite substantially flat surfaces is placed. The surface of the replaceable elastomeric cushion contacting the abutting surface of the mounting structure has a number of projecting members fitting snugly within the orifices of the abutting surface of the mounting structure. The second flat surface in turn is in contact with a glass panel. The glass panel may be then urged against the replaceable elastomeric cushion, separating the glass panel from the mounting structure to avoid damage to the glass panel. The entire assembly may be then assembled in a conventional manner. Since the replaceable cushion is not permanently attached to the support fixture, it may be easily replaced without having to replace the support fixture.

Replacing the replaceable elastomeric cushion is readily accomplished by merely disassembling the glass panel and mounting structure assembly and pulling the replaceable elastomeric cushion away from the abutting surface of the mounting structure so as to disengage the projecting members from the orifices of the abutting surface and inserting the projecting numbers of a new elastomeric cushion therein.

BRIEF DESCRIPTION OF THE DRAWINGS

The invention may be better understood from the following detailed description when read with reference to the drawings in which.

DETAILED DESCRIPTION OF THE PREFERRED EMBODIMENT

Figure 1:
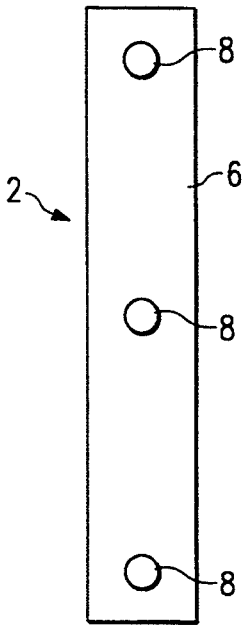
FIG. 1 shows a front elevation view of a first embodiment of the replaceable elastomeric cushion.
Figure 2:
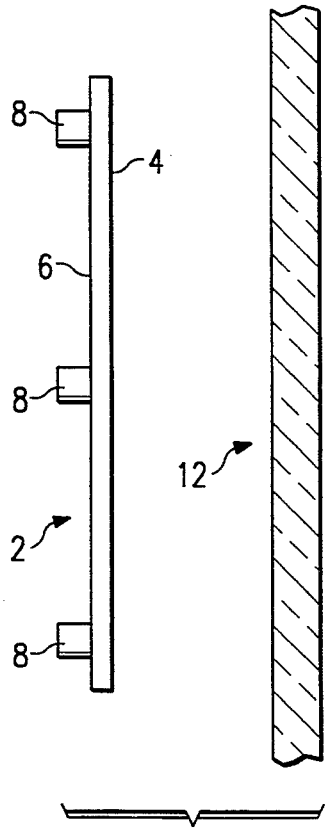
FIG. 2 shows a side elevation view of the first embodiment of the replaceable elastomeric cushion.
Figure 3:
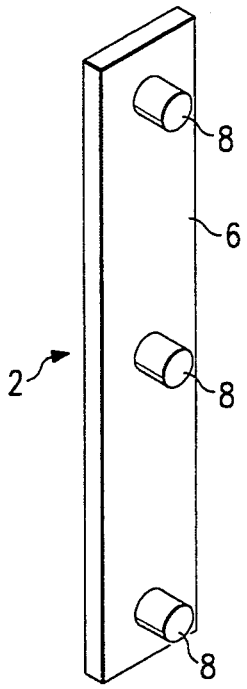
FIG. 3 shows a perspective view of the first embodiment of the elastomeric replaceable cushion.

A first embodiment of the replaceable elastomeric cushion 2 according to the present invention is shown in FIGS. 1 through 3. A rectangularly shaped replaceable cushion 2 has two substantially flat surfaces 4, 6. In the preferred embodiment the cushion 2 has a length of $3\frac{5}{8}$ inches (9.2 cm), a width of $\frac{5}{8}$ inches (1.6 cm) and a thickness of $\frac{5}{8}$ inches (0.31 cm). Of course cushions having different dimensions may be made according to the invention. The surface 4 is substantially smooth and is used to contact a glass panel 12 when the cushion 2 is installed in the mounting assembly which will be discussed below. Several projecting members 8 extend perpendicularly from the surface 6. In the preferred embodiment, the projecting members 8 and the cushion 2 are made of one piece of elastomeric material, such as black rubber. However other elastomeric materials such as plastic may be utilized for the invention. The projecting members 8 are of a cylindrical shape, with one end disposed on the surface 6. In the preferred embodiment each projecting member 8 has a height and diameter of 5/32 inches (0.40 cm). Of course, the projecting member 8 may be formed to be a square, triangle or any other shape and have any appropriate height.

Figure 4:
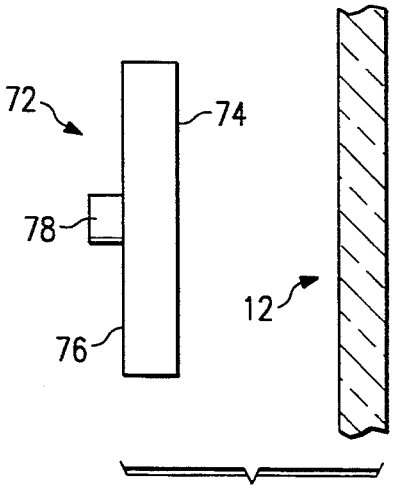
FIG. 4 shows a side elevation view of a second embodiment of the replaceable elastomeric cushion having a single projecting member.
Figure 5:
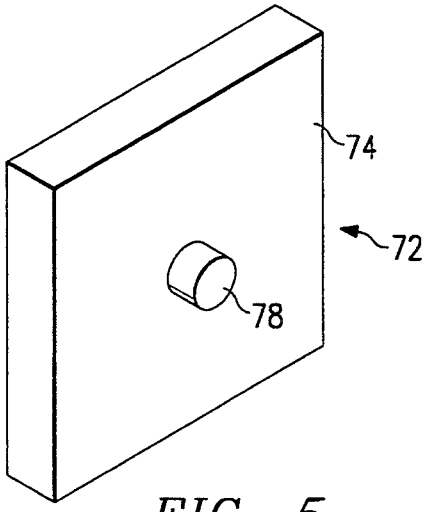
FIG. 5 shows a perspective view of the second embodiment of the replaceable elastomeric cushion.

A second embodiment of the present invention is shown in FIGS. 4 and 5. A cushion 72 has two substantially flat surfaces 74, 76. The surface 74 contacts the glass panel 12 when the cushion 72 is installed in the mounting assembly. In this embodiment, only one projecting member 78 extends perpendicularly from the surface 76. The projecting member 78 is cylindrical in shape, with one end disposed on the surface 76. In the preferred embodiment, projecting member 78 has a height and diameter of 5/32 inches (0.40 cm). Of course, any appropriate shape and height may be used for the projecting member 78. The cushion 72 and the projecting member 78 likewise can be molded from a single piece of black rubber, or other elastomeric material, such as plastic.

Figure 6:
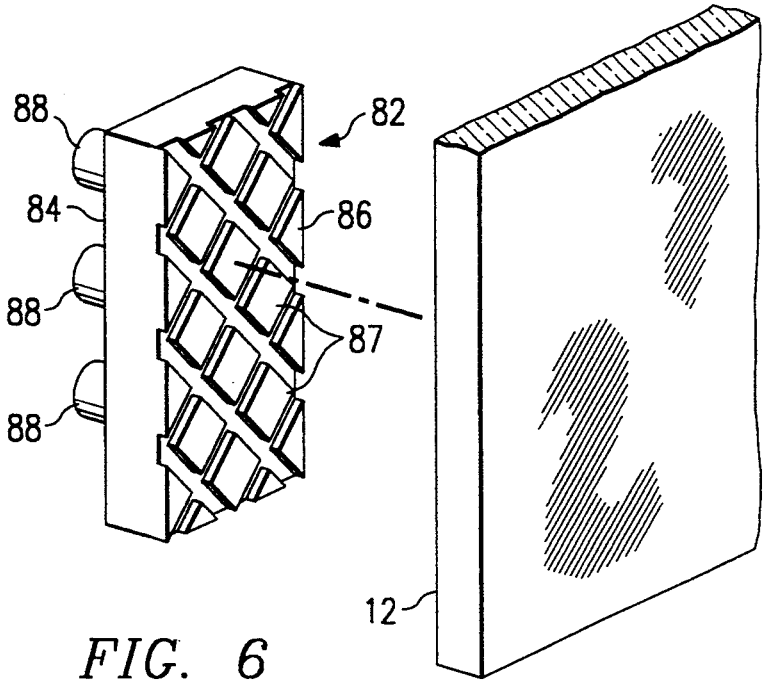
FIG. 6 shows a perspective view of a third embodiment, wherein a surface of the replaceable elastomeric cushion has a textured surface.

A third embodiment of the present invention is shown in FIG. 6, wherein a cushion 82 has a substantially flat surface 84 and an opposite textured surface 86. As may be seen, the textured surface 86 is molded or embossed with a repeating diamond pattern having raised molded squares 87. It should be understood that other patterns may be utilized for providing a texture to the surface 86, such as knurling, small bumps and the like. The projecting members 88 extend out perpendicularly from the surface 84. The projecting members 88 are preferably of a generally cylindrical shape and the projecting members 88 and the cushion 82 are likewise made from an elastomeric material, such as black rubber. The textured surface 86 is intended to be in contact with the glass panel 12 when the cushion 82 is installed on the mounting assembly, as discussed below.

Figure 7:
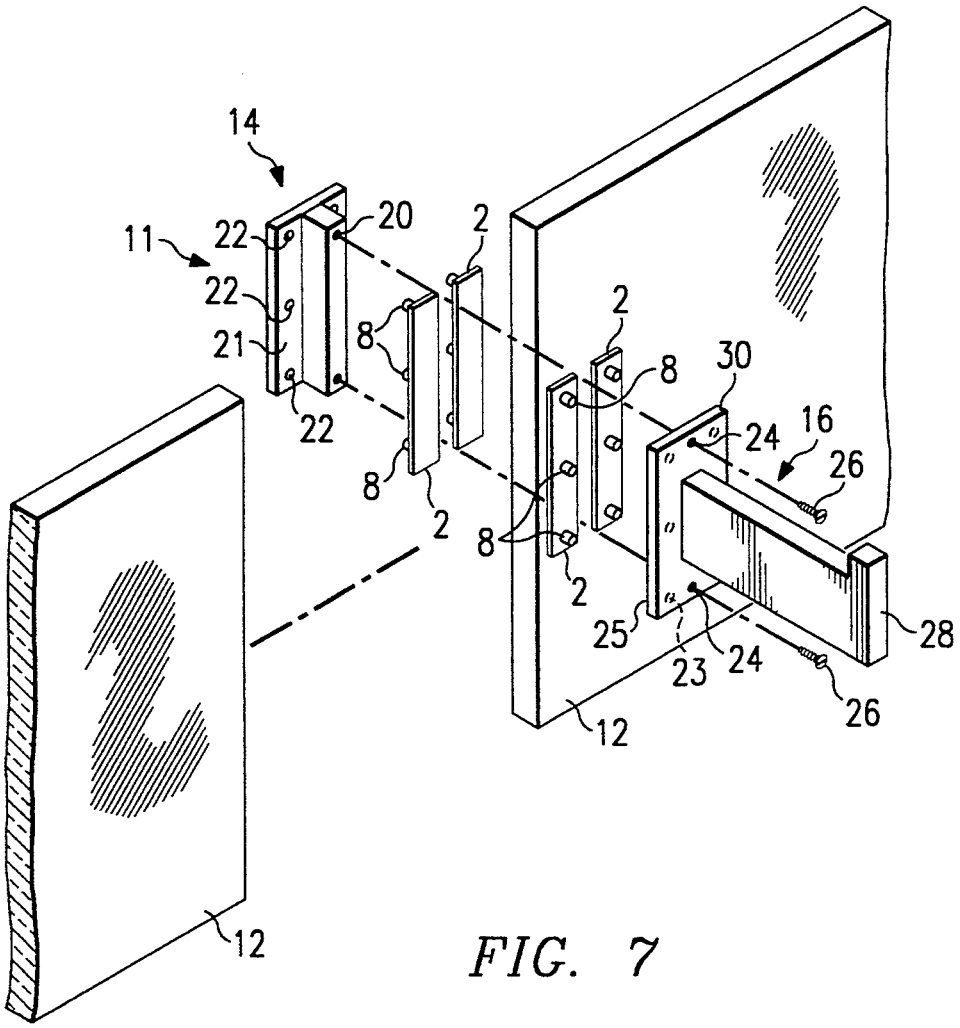
FIG. 7 shows a first assembly of a mounting structure, glass panel and the first embodiment of the replaceable elastomeric cushion combination.
Figure 8:
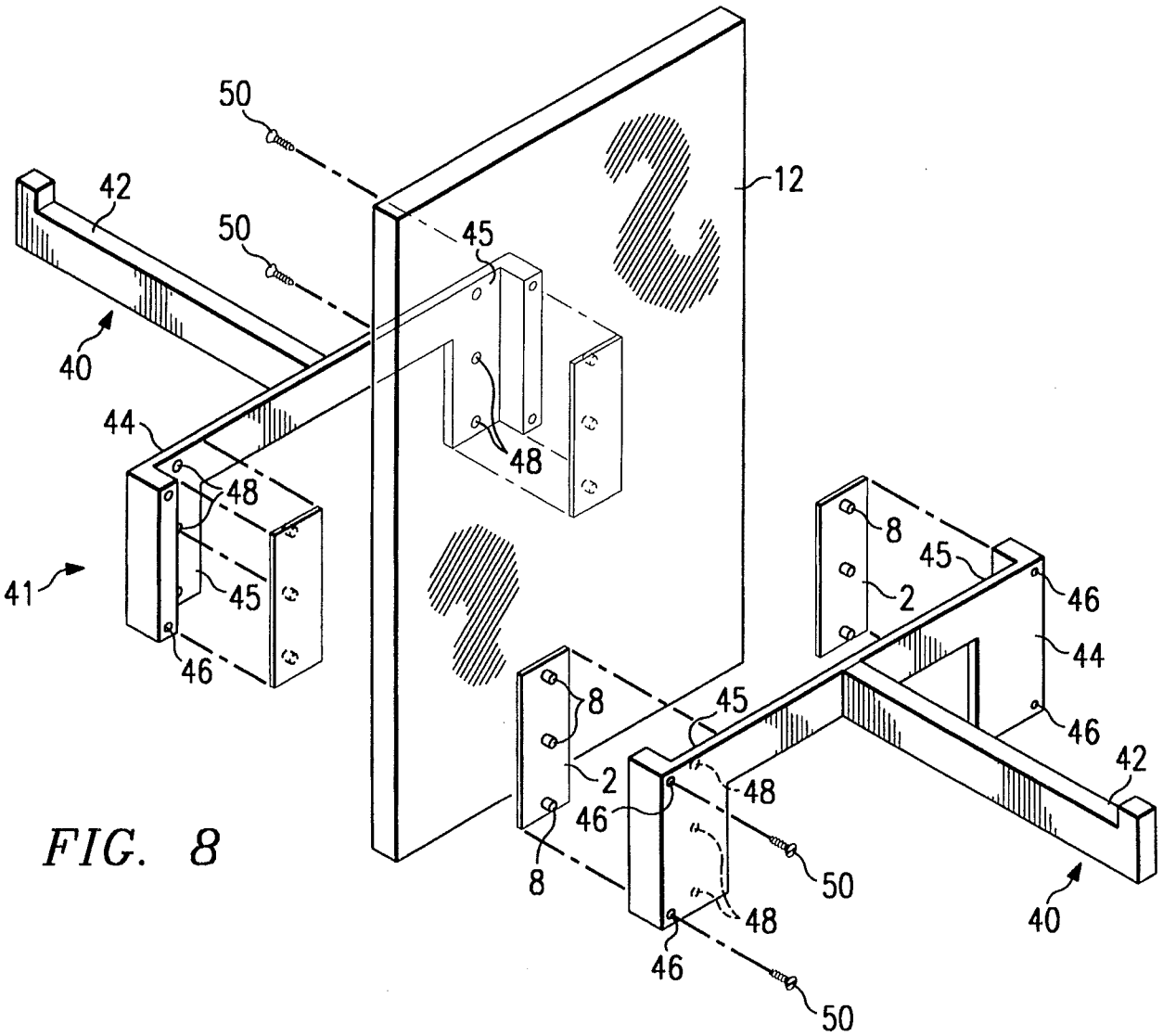
FIG. 8 shows a second assembly of a mounting structure, glass panel and the first embodiment of the replaceable elastomeric cushion combination.

A mounting assembly such as a shelf, display rack or table is shown in two examples illustrated in FIGS. 7 and 8. Of course, other different fixtures may advantageously utilize the cushions 2, 72 and 84 in conjunction with the glass panel 12.

A first example of the present invention as installed in a mounting assembly 11 is shown in FIG. 7. This embodiment is especially useful for display shelves having a glass backing, the glass backing being the aforementioned glass panel 12. FIG. 7 shows four replaceable cushions 2 which are disposed against an abutting surface 21 of a back fixture 14 and an abutting surface 25 of a front fixture 16. The abutting surface 21 of the back fixture 14 has a number of orifices 22 which correspond in size and position to the projecting members 8 of the rubber cushion 2. In this embodiment, the back fixture 14 is made of stamped metal. The back fixture 14 also has two mounting holes 20. The mounting holes 20 and orifices 22 may either be stamped or drilled into the back fixture 14. Of course, other materials and fabrication methods may be utilized for the back fixture 14. The replaceable elastomeric cushions 2 are removably attached to the back fixture 14 by simply inserting the projecting members 8 into orifices 22.

Front fixture 16 is composed of a front piece 30, which further defines the abutting surface 25 having the orifices 23 (shown by dashed lines in FIG. 7) corresponding to the projecting members 8 of the replaceable cushions 2. The front piece 30 also has mounting holes 24 near its top and bottom. A shelf bracket 28 (or other support device) projects out perpendicularly from the front piece 30. Like the back fixture 14, the front fixture 16 is preferably made of stamped metal with the orifices 23 and mounting holes 24 being drilled or stamped. Of course, other materials and fabrication methods may be utilized for the front fixture 16.

Assembly of the mounting assembly 11 of the present embodiment is extremely straightforward. The replaceable cushions 2 are disposed on the front fixture 16 and the back fixture 14 by inserting the projecting members 8 into the orifices 22 and 23 respectively. The projecting members 8 fit snugly in the orifices 22 and 23 so as to restrain the replaceable cushion 2 and prevent accidental separation from the front fixture 16 and the back fixture during assembly. The glass panels 12 are then positioned against the replaceable cushions 2 on the back fixture 14. The front fixture 16 is placed against the glass panels 12 so that the replaceable cushions 2 installed on the front piece 30 are in contact with the glass panels 12 and the mounting holes 24 correspond in location to mounting holes 20. The front fixture 16 is then attached to the back fixture 14 by means of fastening devices, such as bolts 26. The bolts 26 are then tightened so that pressure is generated within the assembly and the glass panels 12 are kept in place by being compressably urged against the cushions 2 located between the front fixture 16 and the back fixture 14. Other methods of assembly may be utilized as well as other fastening means, such as rivets and screws.

A second example of a mounting structure is shown in FIG. 8, which shows a shelf assembly 41 with a backing composed of the glass panel 12. Identical support fixtures 40 are used to sandwich the glass panel 12 therebetween. This embodiment utilizes four replaceable cushions 2 with the projecting members 8. In this embodiment, the support fixture 40 is made of stamped metal, but any similar material may be used. The support fixture 40 has a bracket 42 for installation of further shelving. The bracket 42 is attached to a clamping frame 44, which has a number of mounting holes 46 extending therethrough. The clamping frame 44 also has a number of orifices 48 at abutting surfaces 45 against which the glass panel 12 is supported. The orifices 48 may be drilled into the clamping frame 44 or die stamped or created by some other method. The orifices 48 have the same general shape and location as the projecting members 8 of the replaceable cushions 2, thus allowing the replaceable cushions 2 to be secured via the orifices 48.

The mounting assembly 41 is assembled by means of the steps described below, but other assembly methods may be utilized. The replaceable cushions 2 are installed on the clamping frame 44 by inserting the projecting members 8 in the orifices 48 of the abutting surfaces 45.

The projecting members 8 fit snugly in the orifices 48 so the replaceable cushions 2 are not accidentally separated from clamping frame 44. The glass panel 12 is then placed against the replaceable elastomeric cushions 2 on one of the support fixtures 40. The second support fixture 40 is then positioned with the replaceable cushions 2 in contact with the glass panel 12. The support fixtures 40 are then joined together by means of fastening devices such as bolts 50. Other fastening means may be used, such as rivets and screws. By tightening the bolts 50, the glass panel 12 is thus held in place between the support fixtures 40 by the pressure applied to the replaceable cushions 2 by the clamping frames 44.

Figure 9:
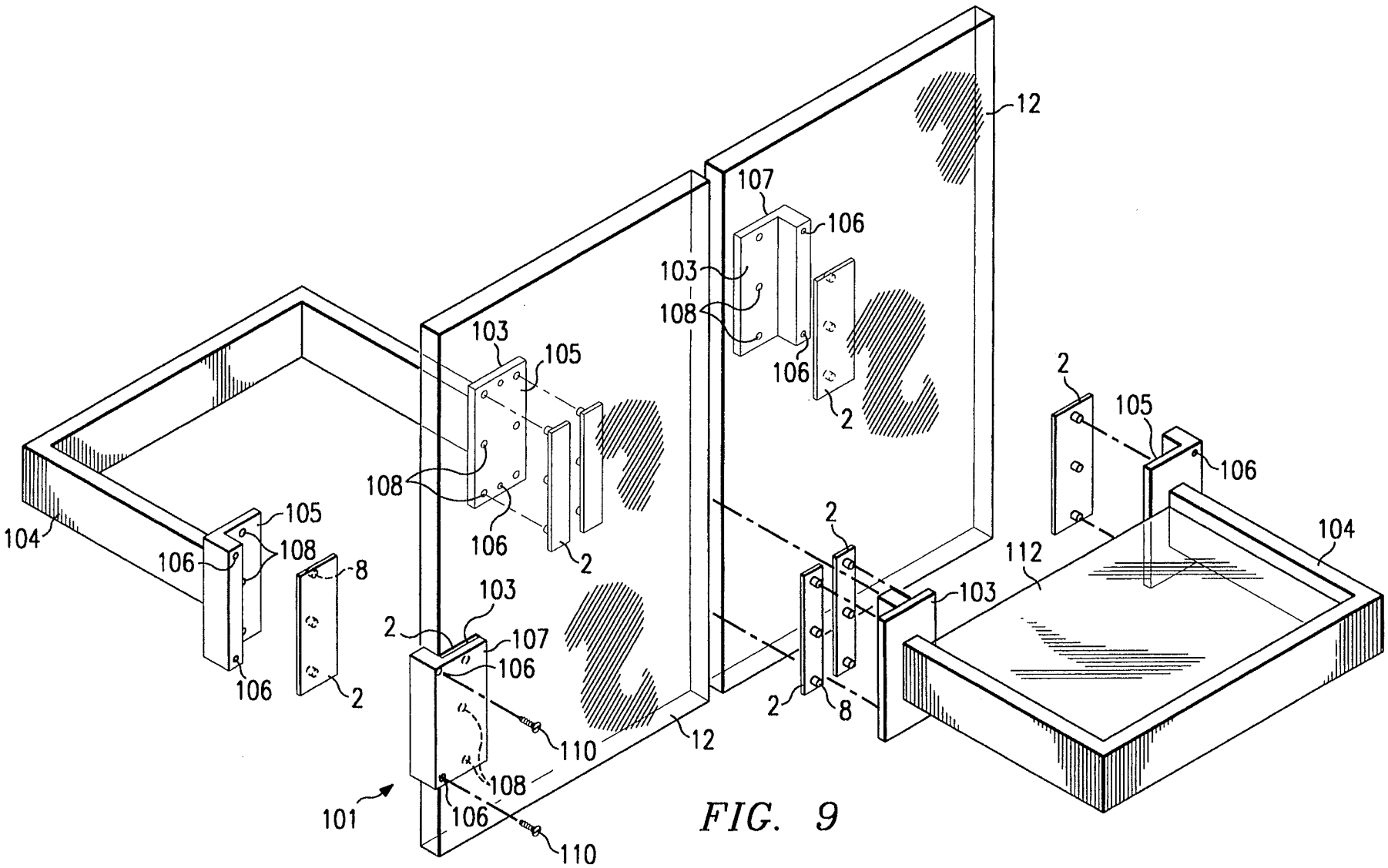
FIG. 9 shows a third assembly of a mounting structure, glass panel and the first embodiment of the replaceable elastomeric cushion combination.

A third example of a mounting structure is shown in FIG. 9, which shows a shelf assembly 101 with backings composed of glass panels 12. Identical "U" shaped support fixtures 104 are used to sandwich the glass panels 12 therebetween. Although the "U" shaped support fixtures 104 are shown in FIG. 9 as being offset, the arrangement can of course be modified to increase the flexibility of the mounting structure. This embodiment utilizes eight replaceable cushions 2 with the projecting members 8 which are disposed against an abutting surface 105 of "U" shaped support fixtures 104 or an abutting surface 103 of mounting fixtures 107 depending on which side surface of glass panel 12 the cushion 2 may be placed. The abutting surfaces 105 and the abutting surfaces 103 have a number of orifices 108 which correspond in size and position to the projecting members 8 of the rubber cushions 2.

The "U" shaped support fixtures 104 and mounting fixtures 107 are made of stamped metal, but any similar material may be used. The "U" shaped support fixtures 104 support glass shelf 112. The "U" shaped support fixtures 104 and the mounting fixtures 107 have a number of mounting holes 106 extending therethrough. The mounting holes 106 and orifices 108 may either be stamped or drilled into their respective fixtures. Of course, other materials and fabrication methods may be utilized for the "U" shaped support fixtures 104 and the mounting fixtures 107.

Assembly of shelf assembly 101 is by means of the steps described below, but other assembly methods may be utilized. The replaceable cushions 2 are installed on the "U" shaped support frames 104 by inserting projecting members 8 in the orifices 108 of the abutting surfaces 105. The projecting members 8 fit snugly in the orifices 108 so the replaceable cushions 2 are not accidentally separated from "U" shaped support fixtures 104. Likewise, the replaceable cushions 2 are installed on mounting fixtures 107 by inserting projecting members 8 in orifices 108 of the abutting surfaces 103. The glass panels 12 are then placed against the opposite side of the replaceable elastomeric cushions 2 on the "U" shaped support fixtures 104. The mounting fixtures 107 are then positioned such that the side of the replaceable cushions 2 without projecting members 8 is in contact with glass panels 12. The mounting fixtures 107 and the "U" shaped support fixtures 104 are then joined together by means of fastening devices such as bolts 110. Other fastening means may be used, such as rivets and screws. By tightening the bolts 110, the glass panels 12 are held in place between the "U" shaped support fixtures 104 and the mounting fixtures 107 by the pressure applied to the replaceable cushions.

These examples are meant to be illustrative of uses of the present invention. Other variations of structures may employ the invention. For example, glass panels may be used in conjunction with the invention in a horizontal orientation such as in a glass shelf or tabletop or used to create a unique design having the glass panels at differing angles of orientation. Of course, the replaceable cushion 72, as shown in FIGS. 4 and 5, or the replaceable cushion 82, as shown in FIG. 6, may be substituted for the replaceable cushion 2 in any of the above embodiments or any other structure. In addition, any number of replaceable cushions 2, 72 or 82 may be utilized in support structures.

The replaceable cushions 2 of the present invention allow for easy replacement when worn out by the constant pressure existing from contact of the glass panel and the support structure and the wear from disassembly and assembly. The cushions may be removed by simply disassembling the support fixtures and the glass panel and replacing the worn cushions with new cushions and reassembling the support fixtures and glass panel. Thus, when the cushions wear out, the support fixtures need not be replaced.

The aforementioned description is not to be interpreted to exclude other glass panel arrangements advantageously employing the present invention. Furthermore, it is to be understood that the above described replaceable cushion is merely an illustrative embodiment of the principles of this invention and that numerous other arrangements and advantages may be devised by those skilled in the art without departing from the spirit and scope of the invention.

What is claimed is:

1. A mounting structure for a display or storage fixture comprising:

a frame structure having an abutting surface, the abutting surface having an orifice provided therein;

a fastening device attached to the frame structure;

a replaceable cushion having a first surface and substantially flat second surface, the first surface having a projecting member inserted within the orifice of the abutting surface and operable to prevent vertical or lateral movement of the replaceable cushion with respect to the abutting surface;

a substantially vertically oriented glass panel supported by the frame structure and in contact with the substantially flat second surface of the replaceable cushion; and the replaceable cushion being compressibly urged against the glass panel by the abutting surface of the frame structure in conjunction with the fastening device.

2. A mounting structure in accordance with claim 1 where the projecting member of the replaceable cushion is cylindrically shaped and the projecting member extends perpendicularly from the first surface of the replaceable cushion.

3. A mounting structure in accordance with claim 1 in which the replaceable cushion is black rubber.

4. A mounting structure in accordance with claim 1 in which the support frame is stamped metal.

5. A mounting structure in accordance with claim 4 in which the orifice is provided through die stamping.

6. A mounting structure in accordance with claim 4 in which the orifice is drilled.

7. The mounting structure of claim 1 wherein the fastening device is a bolt.

8. The mounting structure of claim 1 wherein the fastening device is a rivet.

9. The mounting structure of claim 1 wherein the fastening device is a screw.

10. A mounting structure for a display or storage fixture comprising:

a frame structure having an abutting surface, the abutting surface having an orifice provided therein;

a fastening device attached to the frame structure;

a replaceable cushion having a first surface and a second substantially flat surface, the first surface having a projecting member inserted within the orifice of the abutting surface operable to prevent vertical or lateral movement of the replaceable cushion with respect to the abutting surface and the second surface being textured and substantially flat;

a substantially vertically oriented glass panel in contact with the second substantially flat surface of the replaceable cushion; and the replaceable cushion being compressibly urged against the glass panel by the abutting surface of the frame structure in conjunction with the fastening device.

11. A mounting structure in accordance with claim 10 in which the second surface of the replaceable cushion has a diamond shaped texture.

12. A mounting structure in accordance with claim 10 in which the second surface of the replaceable cushion has a knurled texture.

13. A mounting structure for a display or storage fixture comprising:

a frame structure having an abutting surface, the abutting surface having a number of orifices provided therein;

a fastening device attached to the frame structure;

a replaceable cushion having a first surface and a second surface, the first surface having a number of projecting members inserted within the orifices of the abutting surface and operable to prevent vertical or lateral movement of the replaceable cushion with respect to the abutting surface;

a substantially vertically oriented glass panel in contact with the second surface of the replaceable cushion; and the replaceable cushion being compressibly urged against the glass panel by the frame structure in conjunction with the fastening device.

14. A method for supporting a glass panel for a mounting structure for a display or storage fixture comprising the steps of:

providing a number of orifices on an abutting surface of a frame structure;

forming a replaceable cushion having a first surface and a second surface, the first surface having a number of projecting members;

inserting the projecting members of the replaceable cushion within the orifices of the abutting surface of the frame structure in such a manner to prevent vertical or lateral movement of the replaceable cushion with respect to the abutting surface;

placing the glass panel in a substantially vertically oriented position and in contact with the second surface of the replaceable cushion; and compressibly urging the replaceable cushion against the glass panel by the abutting surface of the frame structure in conjunction with at least one fastening device.

15. A mounting structure for a display or storage fixture comprising:

a first frame structure having an abutting surface, the abutting surface having an orifice provided therein;

a second frame structure having an abutting surface, the abutting surface having an orifice provided therein;

at least one fastening device connecting the first frame structure with the second frame structure;

a pair of replaceable cushions, each having a first surface and a second surface, the first surface having a projecting member;

each of the projecting members of the pair of replaceable cushions being inserted within the orifice of the abutting surface of the first and second frame structure respectively; and a glass panel having first and second opposite surfaces, supported by the first and second frame structure;

the first surface of the glass panel in contact with the second surface of the replaceable cushion; and the second surface of the glass panel in contact with the second surface of the replaceable cushion; and the replaceable cushions being compressibly urged against the first and second surfaces of the glass panel by the abutting surface of the first frame structure and the abutting surface of the second frame structure in conjunction with the fastening device.

16. A mounting structure in accordance with claim 15 where the abutting surfaces of the first and second frame structure contain a number of orifices and the pair of replaceable cushions contain a number of projecting members.

17. A mounting structure in accordance with claim 15 where the abutting surfaces of the first and second frame structure contain an equal number of orifices as the number of projecting members on the pair of replaceable cushions.

18. The mounting structure of claim 15 wherein the fastening device is a bolt.

19. The mounting structure of claim 15 wherein the fastening device is a rivet.

20. The mounting structure of claim 15 wherein the fastening device is a screw.

* * * * *